US010345083B2

(12) United States Patent
Hong

(10) Patent No.: US 10,345,083 B2
(45) Date of Patent: Jul. 9, 2019

(54) DART GAME DEVICE INTERWORKING WITH EXTERNAL DEVICE, GAMING SYSTEM AND METHOD

(71) Applicant: HONG INTERNATIONAL CORPORATION, Seoul (KR)

(72) Inventor: Sang Uk Hong, Seoul (KR)

(73) Assignee: HONG INTERNATIONAL CORPORATION, Seoul (KR)

( * ) Notice: Subject to any disclaimer, the term of this patent is extended or adjusted under 35 U.S.C. 154(b) by 134 days.

(21) Appl. No.: 14/611,798

(22) Filed: Feb. 2, 2015

(65) Prior Publication Data

US 2015/0145211 A1 May 28, 2015

Related U.S. Application Data

(63) Continuation of application No. PCT/KR2013/005258, filed on Jun. 14, 2013.

(30) Foreign Application Priority Data

Aug. 27, 2012 (KR) ..... 10-2012-0093646

(51) Int. Cl.
*F41J 3/00* (2006.01)
*F41J 3/02* (2006.01)
(Continued)

(52) U.S. Cl.
CPC ..... *F41J 5/04* (2013.01); *F41J 3/0009* (2013.01); *F41J 3/0028* (2013.01); *F41J 3/02* (2013.01);
(Continued)

(58) Field of Classification Search
CPC .. F41J 5/04; F41J 3/0009; F41J 3/0028; F41J 3/02; F41J 5/14
See application file for complete search history.

(56) References Cited

U.S. PATENT DOCUMENTS 4,415,162 A 11/1983 Sheppard
5,156,643 A * 10/1992 Grubek ..... F41J 5/04 273/148 B
(Continued)

FOREIGN PATENT DOCUMENTS

CN 101282769 A 10/2008
CN 202074886 U 12/2011
(Continued)

OTHER PUBLICATIONS

International Search Report for PCT/KR2013/005258 dated Sep. 4, 2013, citing the above refrences(s).
(Continued)

*Primary Examiner* — Eugene L Kim
*Assistant Examiner* — Jeffrey S Vanderveen
(74) *Attorney, Agent, or Firm* — Studebaker & Brackett PC

(57) ABSTRACT

The present disclosure relates to a dart game device interworking with at least one external device. The dart game device includes a dart target having a plurality of point regions, a sensing unit configured to sense a hit to the dart target by a dart, a light source unit configured to output light in a light pattern, a sound source unit configured to output sound in a sound pattern, and a communication unit configured to communicate with the external device and control the external device to output light in the light pattern or to output sound in the sound pattern. The light and sound patterns depend on an occurrence of an event.

17 Claims, 16 Drawing Sheets

(51) Int. Cl.

| | |
|---|---|
| ***F41J 5/04*** | (2006.01) |
| ***F41J 5/14*** | (2006.01) |
| ***F41J 5/24*** | (2006.01) |
| ***G07F 17/32*** | (2006.01) |

(52) U.S. Cl.
CPC . *F41J 5/14* (2013.01); *F41J 5/24* (2013.01); *G07F 17/3225* (2013.01)

(56) References Cited

U.S. PATENT DOCUMENTS

| | | | | |
|---|---|---|---|---|
| 7,487,971 | B2 | 2/2009 | Angles | |
| 8,162,731 | B2 * | 4/2012 | Noda | F41J 3/00 273/374 |
| 2003/0160390 | A1 * | 8/2003 | Lamberti | A63B 67/002 273/378 |
| 2011/0111846 | A1 | 5/2011 | Ciarrocchi | |
| 2012/0083342 | A1 | 4/2012 | Cross et al. | |

FOREIGN PATENT DOCUMENTS

| | | | |
|---|---|---|---|
| GB | 2314513 | B | 1/1998 |
| JP | 09-220364 | A | 8/1997 |
| JP | 2006-212224 | A | 8/2006 |
| JP | 2007-330546 | A | 12/2007 |
| JP | 2007330630 | A | 12/2007 |
| JP | 2009-225879 | A | 10/2009 |
| JP | 2010190487 | A | 9/2010 |
| JP | 2015-530912 | A | 10/2015 |
| KR | 1020110021069 | A | 3/2011 |

OTHER PUBLICATIONS

Chinese Office Action dated Sep. 5, 2016 in connection with the counterpart Chinese Patent Application No. 201380045183.2, citing the above refrences(s).

Japanese Office Action for corresponding Japanese Patent Application No. 2015-529656 dated Mar. 1, 2016, citing the above refrences(s).

Japanese Office Action for corresponding Japanese Patent Application No. 2015-529656 dated Dec. 12, 2016, citing the above refrences(s).

Notification of Third Office Action issued by the Chinese Patent Office dated Nov. 9, 2017, which corresponds to Chinese Patent Application No. 201380045183.2 and is related to U.S. Appl. No. 14/611,798, with English translation.

* cited by examiner

DART GAME DEVICE INTERWORKING WITH EXTERNAL DEVICE, GAMING SYSTEM AND METHOD

CROSS REFERENCE TO RELATED APPLICATION

The present application is a continuation of International Patent Application No. PCT/KR2013/005258, filed Jun. 14, 2013, which claims the benefit of priority to Korean Patent Application No. 10-2012-0093646, filed on Aug. 27, 2012, in the KIPO (Korean Intellectual Property Office). The disclosures of the above-listed applications are hereby incorporated by reference herein in their entirety.

TECHNICAL FIELD

The present disclosure relates to a dart game device interworking with an external device and including a communication unit which communicates with the external device, a light source unit which outputs light, a sound source unit which outputs sound.

BACKGROUND

The statements in this section merely provide background information related to the present disclosure and do not constitute prior art.

In general, a dart refers to a 'small arrow' and is used for a dart game that makes marks by throwing an arrow-shaped dart pin to a centrifugal target marked with figures. The dart game has an advantage that whoever can enjoy the dart game regardless of season anytime anywhere if there are an arrowheaded dart and the dart target.

A dart board in the related art is made of wood or pulp and is configured and used for players to enjoy a play that throws the arrowheaded dart to a target made of a cork or wood material and converts points according to the position thereof to decide a winner. In recent years, the dart board is manufactured and used even in an electronic scheme.

In recent years, while various game methods have been developed and a scoring method is are arranged, and as a result, the dart game is developed to worldwide leisure, all adults and children have conveniently enjoyed the dart game. The dart has various weights of approximately 18 to 30 g and is constituted by a point (tip), that is made of a pointed and sharp metallic material, a barrel (handle), a shaft (board), and a flight (wing). The dart target is divided into 20 wooden fan-shaped equal parts and points are determined as 1 to 20 points, and in a point arrangement, very small points are arranged next to a large point so as to acquire the point only when accurately hitting figures and further, in the point arrangement, the dart target is equally divided into single (making a point which is large as the hit figure), double (making a point which is double as large as the hit figure), triple (making a point which is triple as large as the hit figure), single bulls-eye (a circular external part at the center as 25 points), and double bulls-eye (a circular internal part at the center as 50 points) for the first time toward the center from the outside.

When a player plays a game by using the dart game device, the player generally senses a change in flickering scheme and color of an illumination through the illumination unit of the dart game device, and as a result, the player feels joy and pleasure of the dart game.

However, current dart game devices generate an illumination pattern when an event occurs (for example, hitting the dart target) in only their game devices.

SUMMARY

According to at least one aspect of the present disclosure, there is provided a dart game device interworking with at least one external device. The dart game device includes: a dart target having a plurality of point regions; a sensing unit configured to sense a hit to the dart target by a dart; a light source unit configured tooutput light in a light pattern, wherein the light pattern depends on an occurrence of an event; a sound source unit configured to output sound in a sound pattern, wherein the sound pattern depends on the occurrence of the event; and a communication unit configured to communicate with the external device, and control the external device, in response to the occurrence of the event, to output light in the light pattern, or to output sound in the sound pattern.

According to other aspect of the present disclosure, there is provided a gaming system, comprising a plurality of dart game devices interworking with each other. The each of the dart game devices comprising: a dart target having a plurality of point regions; a sensing unit configured to sense a hit to the dart target by a dart; a light source unit configured to output light in a light pattern, wherein the light pattern depends on an occurrence of an event; a sound source unit configured to output sound in a sound pattern, wherein the sound pattern depends on the occurrence of the event; and a communication unit configured to communicate with at least one further dart game device among the plurality of dart game devices, and control the at least one further dart game device, in response to the occurrence of the event, to output light in the light pattern, or to output sound in the sound pattern.

According to other aspect of the present disclosure, there is provided a method of playing a dart game performed by a plurality of dart game devices. The method comprising: detecting, by one of the plurality of dart game devices, an occurrence of an event; reading, by the one of the plurality of dart game devices, a light pattern and a sound pattern, which are depend on the occurrence of the event; outputting, by the one of the plurality of dart game devices, light in a light pattern and sound in a sound pattern; communicating, by the one of the plurality of dart game devices, with at least one further dart game device among the plurality of dart game devices to output light in the light pattern and to output sound in the sound pattern; and outputting, by the at least one further dart game device among the plurality of dart game devices, light in the light pattern and sound in the sound pattern.

Figure 1:
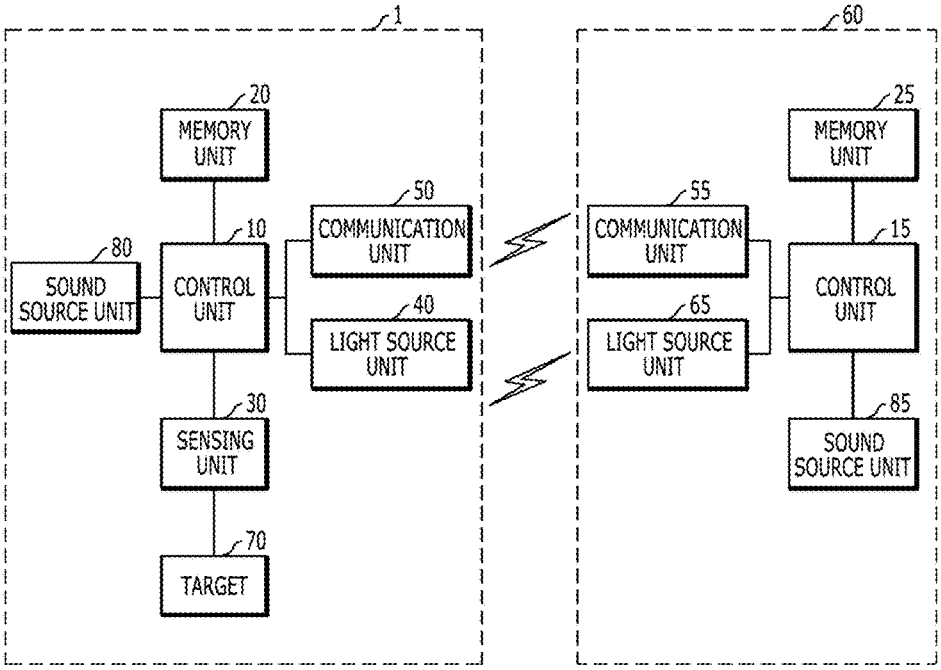
FIG. 1 is a schematic block diagram of a dart game device linked with an external device according to some embodiments of the present disclosure.

Various embodiments are described with reference to the drawings, however, similar reference numerals are used to represent similar elements throughout the drawings. For description, in the specification, various descriptions are presented to provide appreciation of the present disclosure. However, it is apparent that the embodiments can be executed without the specific description. In other examples, known structures and devices are presented in a block diagram form in order to facilitate description of the embodiments.

DETAILED DESCRIPTION

The following description provides a brief description of one or more embodiments in order to provide basic appreciation of the present disclosure. This section is not a comprehensive overview for all available embodiments and does not intend to identify a core element among all elements or cover the scopes of all of the embodiments. An object of this section is to provide concepts of one or more embodiments in a simplified form as an introduction for a detailed description to be presented later.

The characteristics of the dart game device of the present disclosure is a concept in which one dart game device interworks with one or more external devices and the concept of the present disclosure is implemented by the following components.

FIG. 1 is a schematic block diagram of a dart game device linked with an external device according to some embodiments of the present disclosure.

As illustrated in FIG. 1, the dart game device 1 interworking with the external device according to some embodiments of the present disclosure include a control unit 10; a memory unit 20; a sensing unit 30; a light source unit 40; a sound unit 80; a communication unit 50; and a target 70. In some embodiments, the dart game device 1 includes a display unit; a voice output unit; an operation unit, and the like, in addition to the components shown in FIG. 1.

In some embodiments, the dart game device 1 communicates with the external device 60 interworking therewith by using the communication unit 50.

The control unit 10 is connected with the memory unit 20, the sensing unit 30, the light source unit 40, the sound source unit 80, the communication unit 50, and the external device 60 to serve to control the components as illustrated in FIG. 1.

The control unit 10, in some embodiments, includes one or more physical, actual storage devices. Examples of physical, actual storage devices include, but are not limited to, magnetic media such as, a hard disk, a floppy disk, and a magnetic tape, optical media such as a CD-ROM and a DVD, magneto-optical media such as a floptical disk, and a hardware device configured especially to store and execute a program, such as a ROM, a RAM, a solid state drive, and a flash memory. The control unit 10 is implemented, in some embodiments, by one or more programmed processors and/or application-specific integrated circuits (ASICs).

In some embodiments, the memory unit 20 stores patterns of a change in flickering scheme and color of light outputted from the light source unit, and patterns of a sound effect ouputted from the sound unit, depending on an occurrence of an event of the dart game device. In some embodiments, the memory unit 20 stores the patterns of the light source unit and the sound source unit of the dart game device and stores patterns of the light source unit and an sound source unit of the external device interworking with the dart game device. Further, the patterns of the light source unit and the sound source unit are received from all communicatable components including the external device through the communication unit 50 to be stored in the memory unit 20 and executed through the light source unit and the sound source unit, while not being stored in the memory unit 20.

Further, the patterns stored in the memory unit 20 of the dart game device are transmitted to the external device to be executed through the light source unit and the sound source unit of the external device while being stored or not being in the memory unit of the external device. Further, in the dart game device or the external device, whether the pattern stored in the memory unit 20 is to be executed or whether the pattern received by the communication unit 50 is to be executed is selected according to some embodiments.

The memory unit 20 as an internal memory of the dart game device or a memory or a hard disk of a computer embedded therein stores a dart game program, patterns of light and sound source units, voice, a screen, and the like.

Herein, the patterns of the light source units mean the patterns of a change in flickering scheme and color of the light source or a combination of the patterns.

Further, the patterns of the sound source effect of the sound source unit means a pattern of combinations of all sounds issued from the sound source unit.

Figure 4:
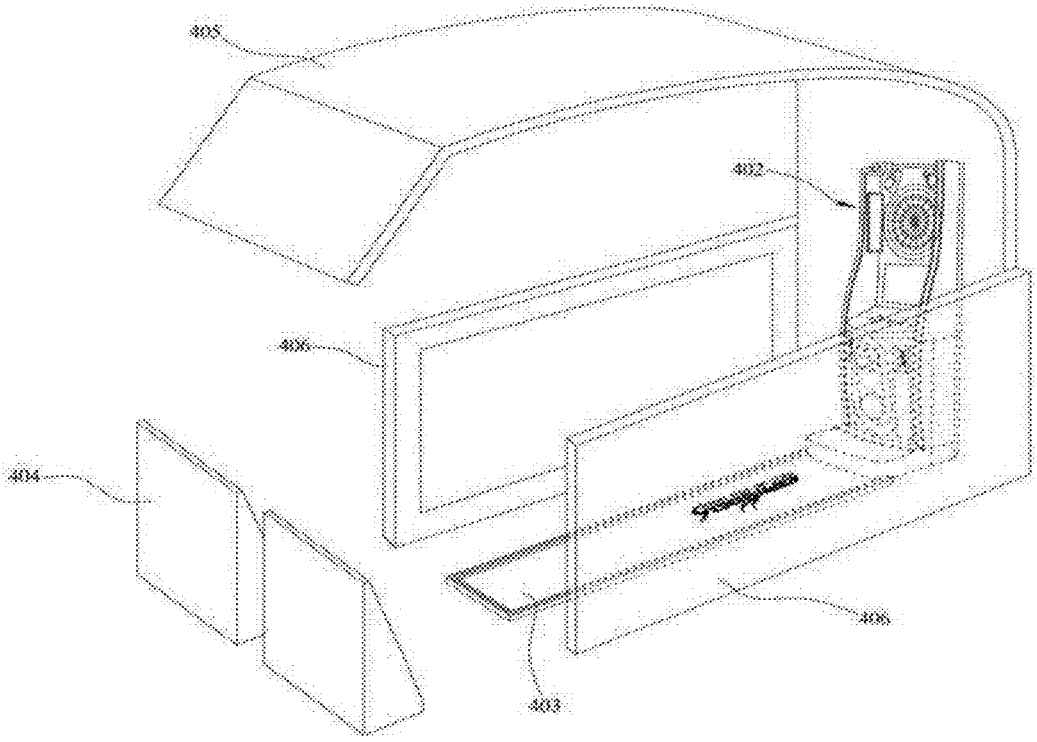
FIG. 4 is a schematic diagram of the dart game device according to some embodiments of the present disclosure.

A dart game device 401 according to some embodiments of the present disclosure is illustrated in FIG. 4.

The dart game device according to some embodiments of the present disclosure includes all of a plate structure 403 of the dart game device, a behind structure 404 disposed behind the player, a roof structure 405 configured to roof the player, a side structure 406 disposed on a side of the player, and the like in addition to a body 402 of the dart game device. The structure includes a booth form, a throw line, a path, a pole, a wall, and the like, but is not limited thereto.

The light source unit and the sound source unit according to some embodiments of the present disclosure are installed in some or all of the plate structure of the dart game device, the structure disposed behind the player, the structure configuring the upper roof above the player, the structure disposed on the side of the player, and the like in addition to the body of the dart game device.

The light source unit according to some embodiments of the present disclosure includes one or more light emitted diodes (LEDs), but is not limited thereto.

According to some embodiments of the present disclosure, a light source unit and a sound source unit installed in the body of the dart game device, a light source unit and a sound source unit installed on the plate structure of the dart game device, a light source unit and a sound source unit installed in the behind structure disposed behind the player, a light source unit and a sound source unit installed in the side structure disposed on the side of the player, and the like interwork with each other in real time or non-real time, and as a result, the patterns of the change in flickering scheme and color of the light source unit and the patterns of the sound source effect of the sound source unit are executed depending on an occurrence of the event.

Figure 5:
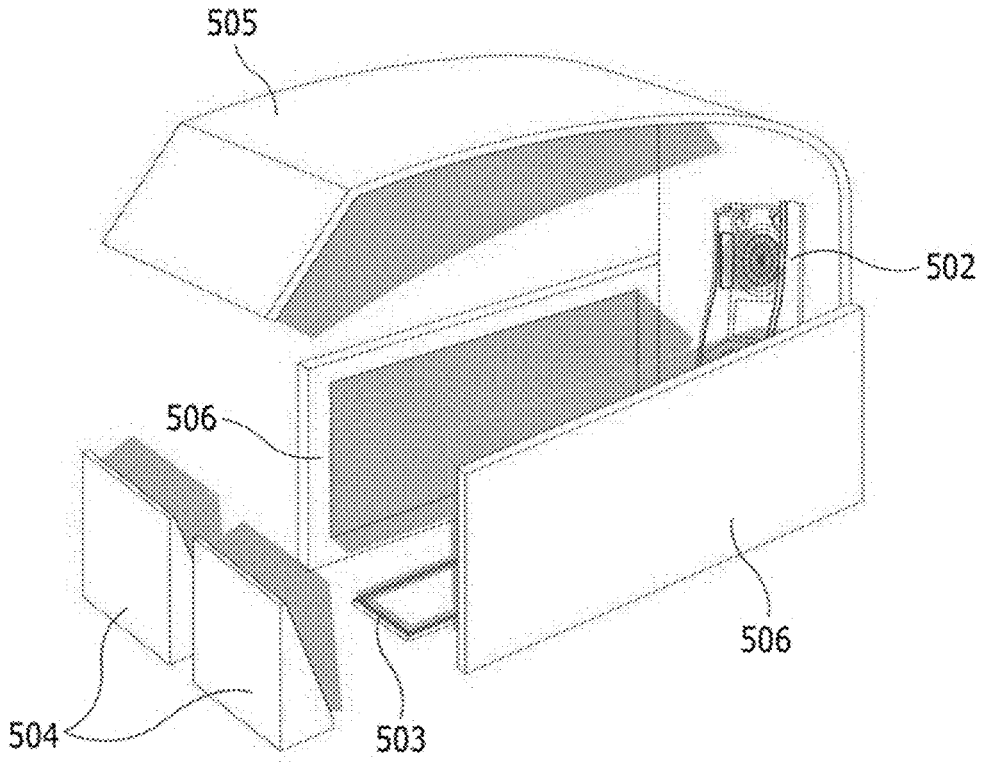
FIG. 5 is a schematic diagram of a light pattern of the dart game device according to some embodiments of the present disclosure.

In some embodiments, referring to FIG. 5, the light source unit installed in the body 502 of the dart game device, the light source unit installed on the plate structure 503 of the dart game device, the light source unit installed in the behind structure 504 disposed behind the player, the roof structure 505 configured to roof the player, the light source unit installed in the one or more side structures 506 disposed on one or more sides of the player, and the like flicker with the same color (for some embodiments, a blue, and the like) and the sound source units installed in the respective structures generate the same sound (for some embodiments, a buzzer sound, and the like) as an event occurs.

Figure 6:
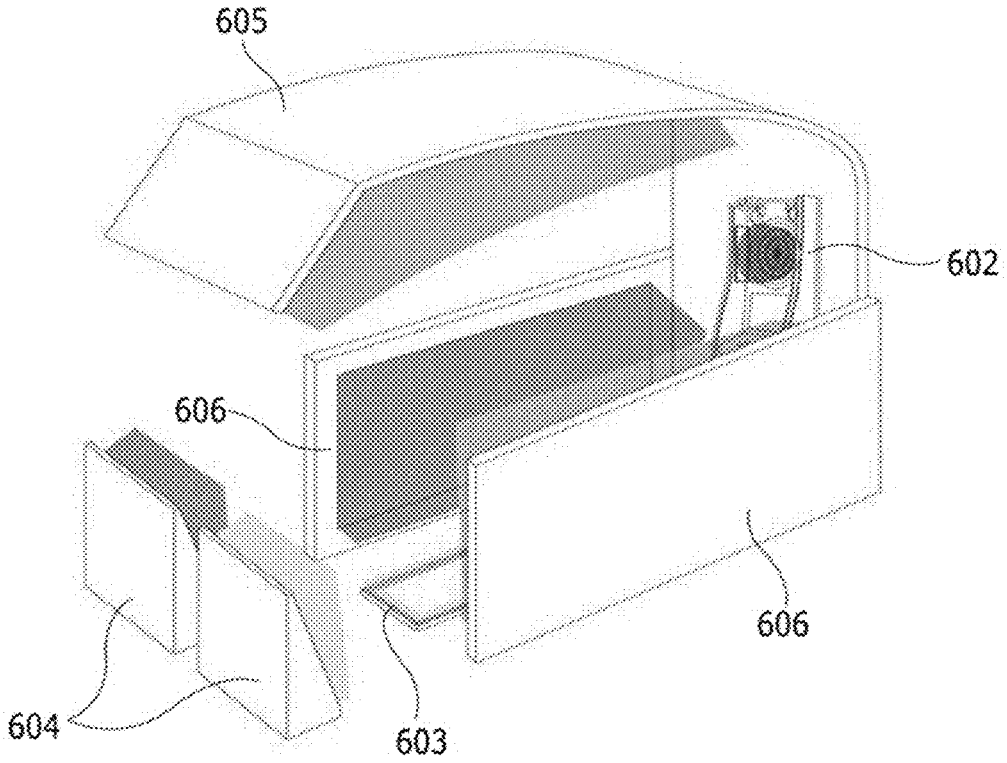
FIG. 6 is a schematic diagram iof a light pattern of the dart game device according to some embodiments of the present disclosure.
Figure 7A:
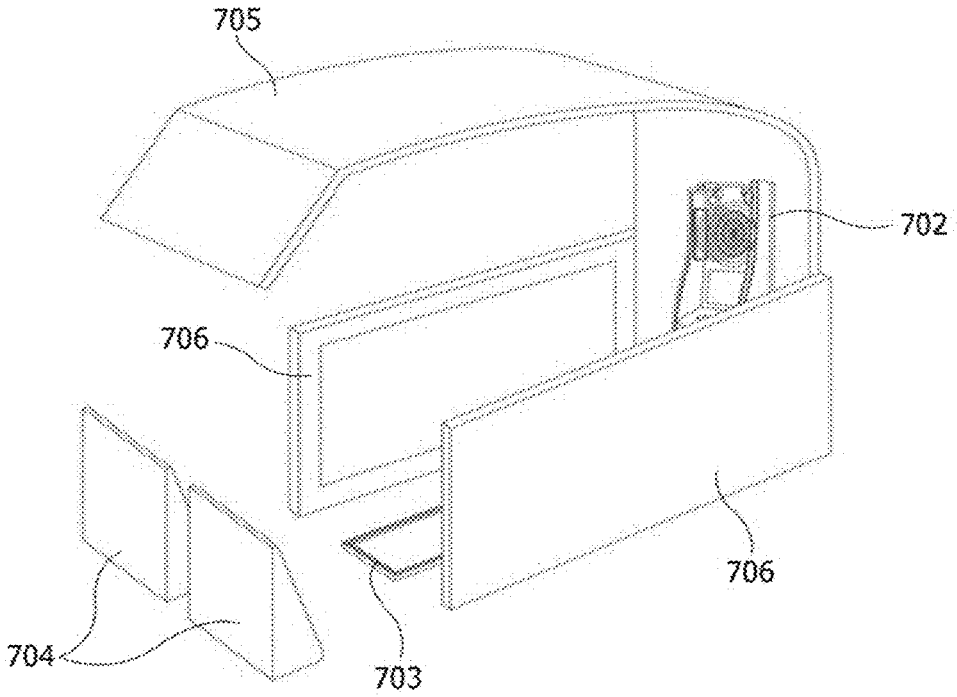
FIGS. 7*a* to 7*e* are schematic diagrams of a light pattern of the dart game device according to some other embodiments of the present disclosure.
Figure 7B:
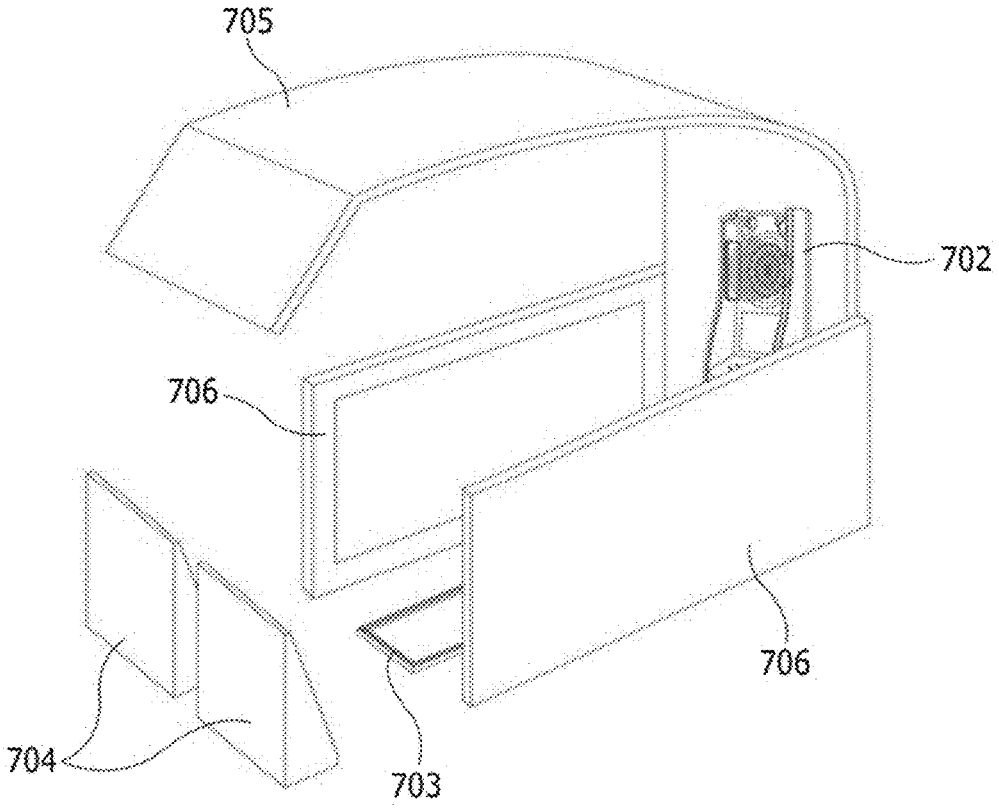
Figure 7C:
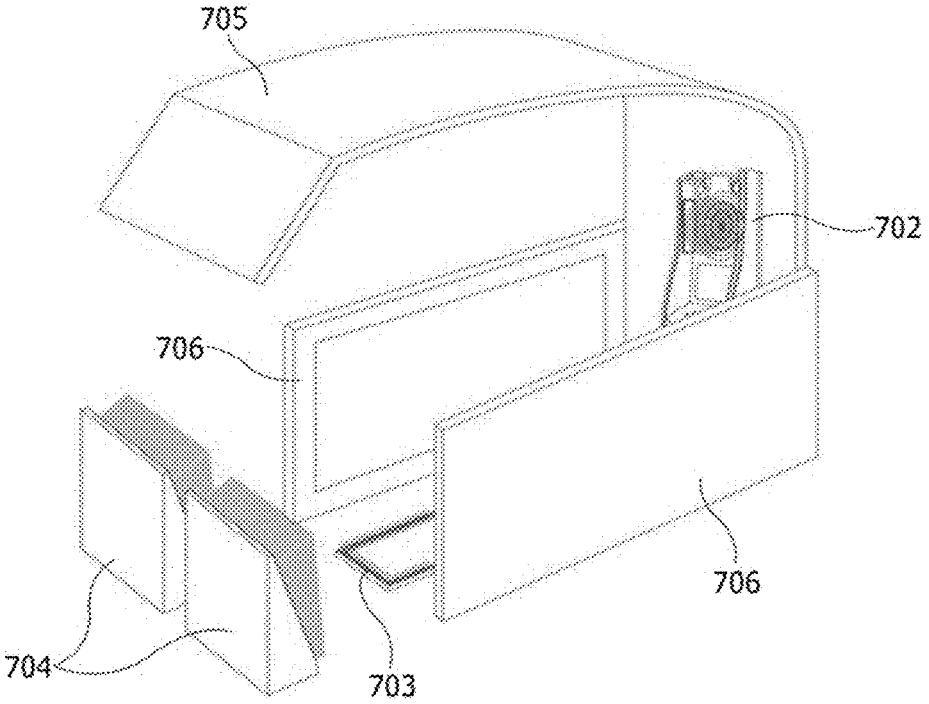
Figure 7D:
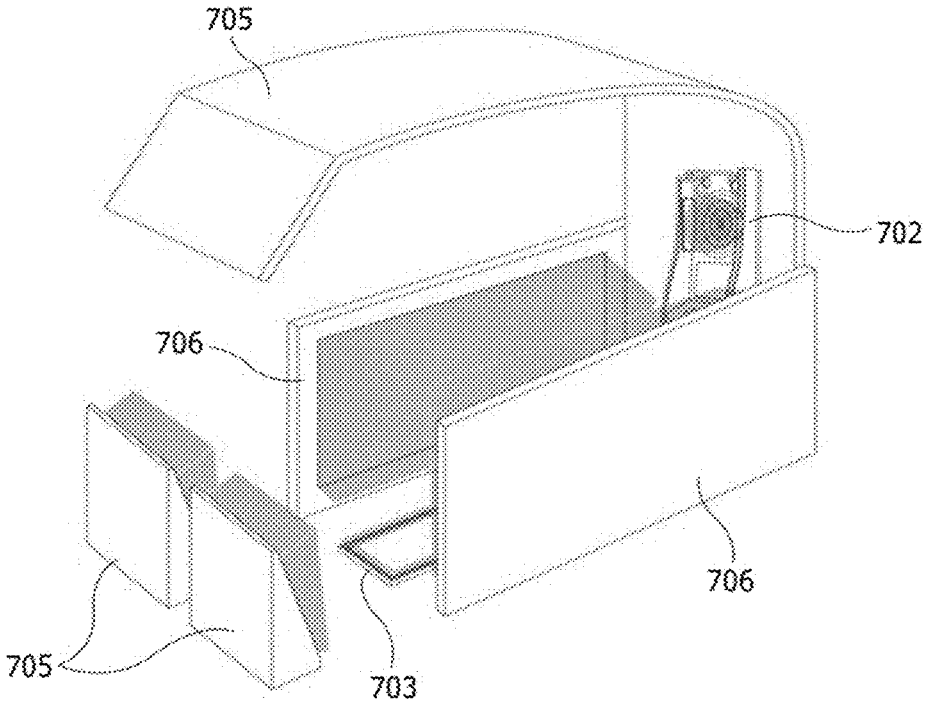
Figure 7E:
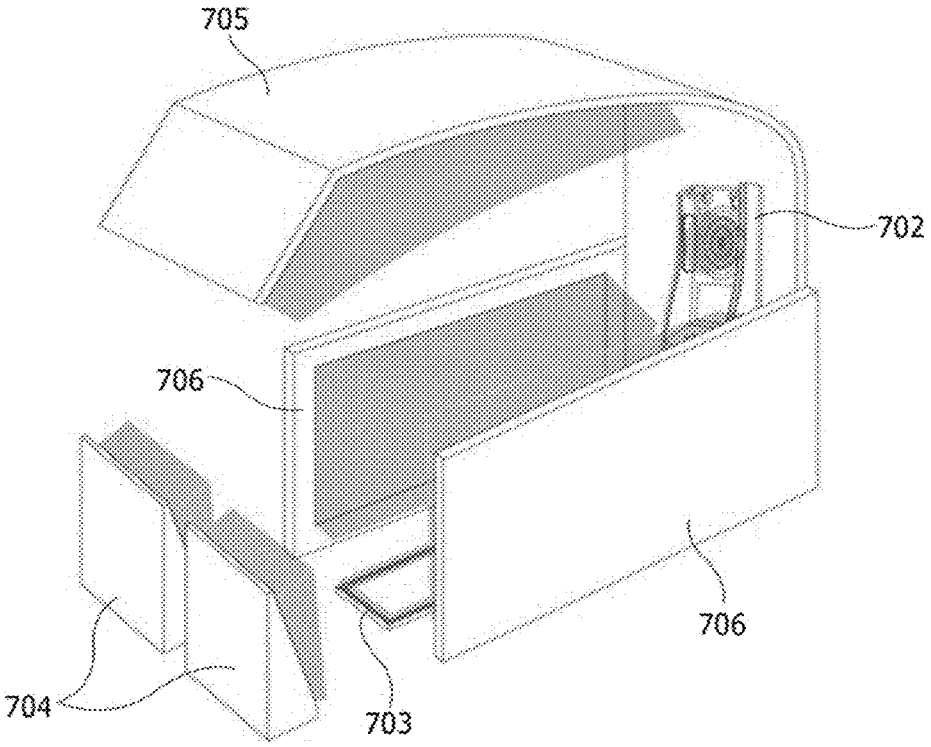

Further, according to some other embodiments referring to FIG. 6, the light source unit installed in the body 602 of the dart game device, the light source unit installed on the plate structure 603 of the dart game device, the light source unit installed in the behind structure 604 disposed behind the player, the roof structure 605 configured to roof the player, the light source unit installed in the one or more side structures 606 disposed on the side of the player, as the light flickers with different colors, respectively and the sound source units installed the respective structures generate different sounds, respectively as an event occurs.

In other words, the dart game device according to some embodiments of the present disclosure includes a light source unit which is oriented to at least two planes. From the viewpoint of a player of the dart game device, the light source unit installed behind the player, on the side of the player, or on the plate structure of the dart game device is additionally included even in addition to an light source unit installed on a front surface of the dart game device to visually provide various effects to the player.

Further, according to some other embodiments, referring to FIGS. 7*a* to 7*e*, the light source unit installed in the body 702 of the dart game device, the light source unit installed on the plate structure 703 of the dart game device, the light source unit installed in the behind structure 704 disposed behind the player, the roof structure 705 configured to roof the player, the light source unit installed in the side structure 706 disposed on the side of the player, and the like sequentially flickers with the same color or different colors, and the sound source units installed in the respective structures sequentially generate sounds as an event occurs.

Referring to FIGS. 7*a* to 7*e*, the light source units are turned on in the order of a target part of a dart game body 702, the plate structure 703, the behind structure 704, the side structure 706, and the loof structure 705, and as a result, a more splendid light source effect is achieved. The sound source units installed in the respective structures generate sound according to a predetermined order.

Figure 8A:
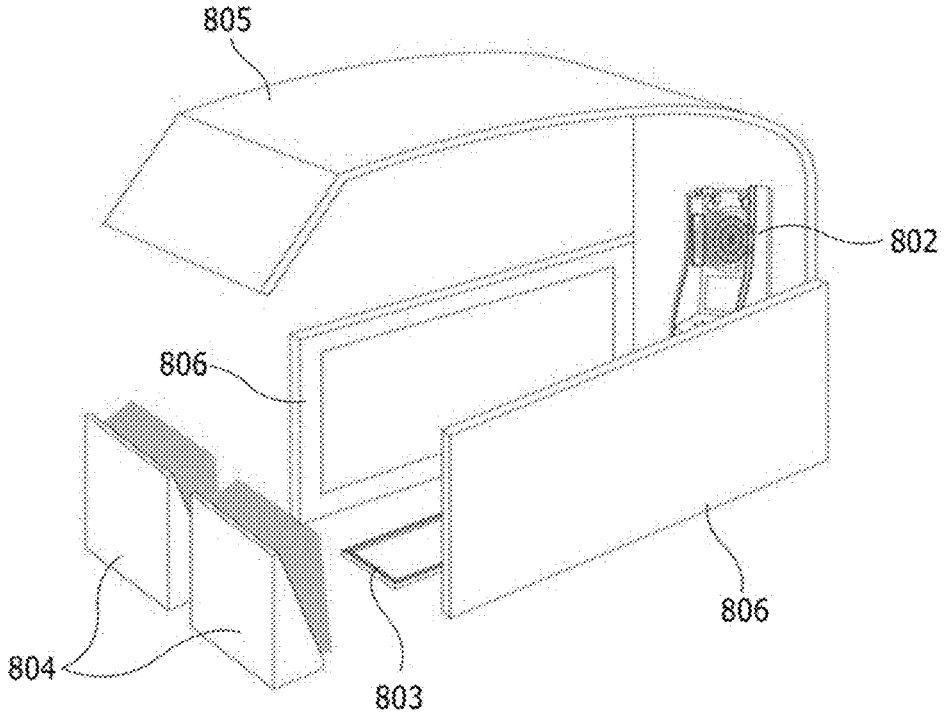
FIGS. 8*a* and 8*b* are schematic diagrams of a light pattern of the dart game device according to some other embodimentsof the present disclosure.
Figure 8B:
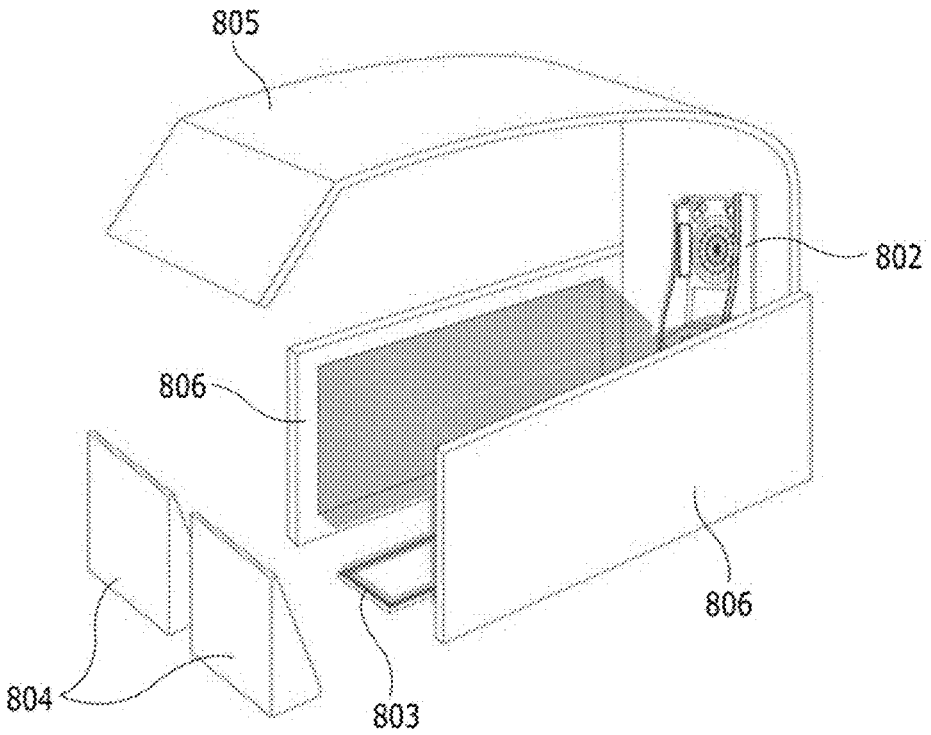

Further, according to some other embodiments, referring to FIGS. 8*a* and 8*b*, as an event occurs, the light source unit installed in the body 802 of the dart game device and the light source unit installed in the behind structure 804 disposed behind the player are synchronized to flicker with the same color at the same time, the light source unit installed on the plate structure 803 of the dart game device and the light source unit installed in the side structure 806 disposed on the side of the player flickers with the same color at the same time, the roof structure 805 configured to roof the player, and the sound source unit installed in the body 802 of the dart game device and the sound source unit installed in the behind structure 804 disposed behind the player are synchronized to generate sound, and the sound source unit installed on the plate structure 803 of the dart game device and the sound source unit installed in the side structure 806 disposed on the side of the player are synchronized to generate the sound.

In FIG. 8*a*, the body 802 and the behind structure 804 of the dart game device are synchronized to be lit up and in FIG. 8*b*, the plate structure 803 and the side structure 806 are synchronized to be lit up.

A form in which the patterns are executed in the light source unit and the sound source unit installed as above is an embodiment, but is not limited thereto.

Further, in some embodiments, the event includes at least one of identification of the player, hitting the dart target by the dart, a change of the player, game ending, and like. When the dart hits the dart target, the patterns in change in various flickering schemes and colors are determined by considering which part of the dart target the dart hits when the dart hits the dart target. The above events are some embodiments and it is appreciated that the event includes all events which occur while executing the dart game.

The sensing unit 30 as a unit that senses a hit to the target 70 by a dart is a sensor that senses a part of dart target hit by the dart when the dart hits the dart target. It is detected that the dart hits the target from the sensor. The sensing unit 30 calculates a point to call a prestored light pattern corresponding to a relevant point through the light source units from the memory unit 20. The light source units 40 and 65 display the prestored light pattern. Meanwhile, this point is also displayed through the display unit.

The external device 60 means all devices that interworks with the dart game device and in detail, is another dart game device, but is not limited thereto. When the external device 60 is an external dart game device, the external device includes some or all of a plate structure of the external dart game device, a behind structure disposed behind a player of the external dart game device, a roof structure roofing the player of the external dart game device, one or more side structures disposed on one or more sides of the player of the external dart game device, and the like in addition to the body of the external dart game device. The structure includes the booth form, the throw line, the path, the pole, the wall, and the like, but is not limited thereto.

The light source unit and the sound source unit of the external device are installed in some or all of the plate structure of the dart game device, the structure disposed behind the player, the structure configuring the upper roof above the player, the structure disposed on the side of the player, and the like in addition to the body of the dart game device.

The external device 60 includes a memory unit 25, a control unit 15, a communication unit 55, a light source unit 65, and a sound source unit 85.

The control unit 15 interworks with the dart game device 1 of the present disclosure to control the external device 60 and control the external device 60 apart from the dart game device 1.

The control unit 15, in some embodiments, includes one or more physical, actual storage devices. Examples of physical, actual storage devices include, but are not limited to, magnetic media such as, a hard disk, a floppy disk, and a magnetic tape, optical media such as a CD-ROM and a DVD, magneto-optical media such as a floptical disk, and a hardware device configured especially to store and execute a program, such as a ROM, a RAM, a solid state drive, and a flash memory. The control unit 15 is implemented, in some embodiments, by one or more programmed processors and/or application-specific integrated circuits (ASICs).

Further, it is illustrated that the control unit 10 is present in the dart game device 1 of the present disclosure and it is described that the control unit 15 is present in the external device 60. However, in different embodiments, the control units 10 and 15 are not present in the dart game device 1 and the external device 60 of the present disclosure, but are present as an external component and further, the control units 10 and 15 are the same component.

The memory unit 25 of the external device 60 stores a pattern of the external device 60. By this configuration, when the event occurs in the original dart game device, the patterns of the light source unit and the sound source unit of the external device among the patterns stored in the memory unit 20 are received to execute the corresponding patterns through the light source unit 65 and the sound source unit 85.

The memory unit 25 is illustrated as the component in the external device 60, but in some embodiments, the memory unit 25 is present as the external component. In some embodiments, the memory units 20 and 25 are the same component.

The external device 60 communicates with the dart game device 1 or other components by using the communication unit 55. The event which occurs in the dart game device 1 is sensed through the communication and the pattern is received from the dart game device 1 or other components to be executed or the pattern stored in the memory unit is executed according to the event which occurs. The communication unit includes a communication interface and patterns stored in a separate server are correspondingly downloaded from the server. Further, in the dart game device, a player independently enjoys the game in each business office through the communication unit off-line and multiple players enjoy the dart game together at different places on-line. In this case, the patterns of the light source units and the sound source units of the dart game devices, which are at different places are also set to be controllable.

As described in the dart game device 1, whether the pattern transmitted by the communication unit is to be executed or whether the pattern stored in the memory unit is to be executed is determined according to some embodiments.

The light source unit 65 of the external device is installed by using one or more light emitted diodes (LEDs), and the like and there is no particular limit for the light source unit itself.

Figure 2:
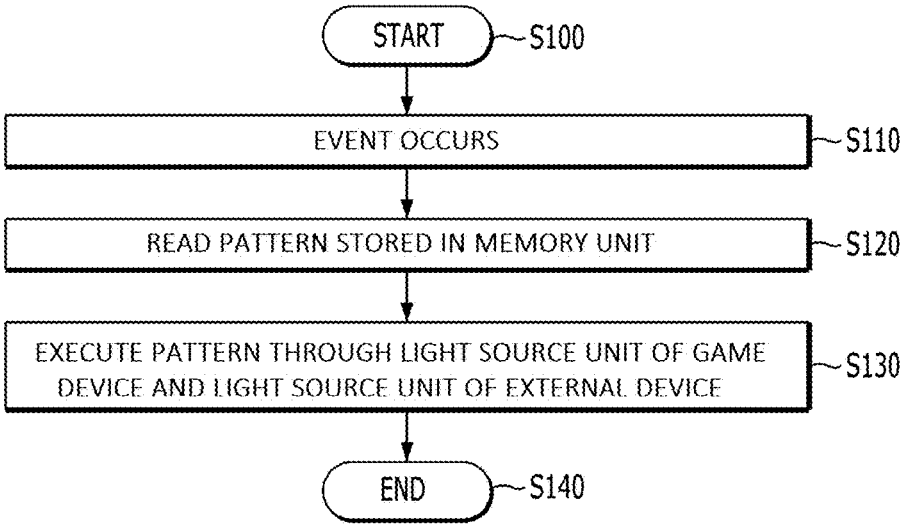
FIG. 2 is a flowchart of a method using a dart game device interworking with the external device according to some embodiments of the present disclosure.

FIG. 2 is a flowchart of a method using the dart game device interworking with the external device, according to some embodiments of the present disclosure.

When an event occurs (S110), a control unit of the dart game device recognizes the corresponding event. The event includes at least one selected from the group consisting of an identification of a player, the hit to the dart target by the dart, a change of the palyer, and game ending.

The control unit reads a pattern previously stored in a memory unit of the dart game device based on contents of the recognized event (S120) and transmits the pattern to the external device while executing the read pattern through a light source unit 40 of the dart game device to execute the pattern even through a light source unit 65 of the external device (S130).

The flowchart is related to some embodiments of the present disclosure and the flowchart is not limited thereto. Therefore, the pattern previously stored in the memory unit is not read according to other embodiments and the pattern is transmitted and executed through the communication unit as aforementioned. Further, in other embodiments, the same pattern of sound is excuted in the dart game device and the external device, by the steps described in FIG. 2.

Figure 3:
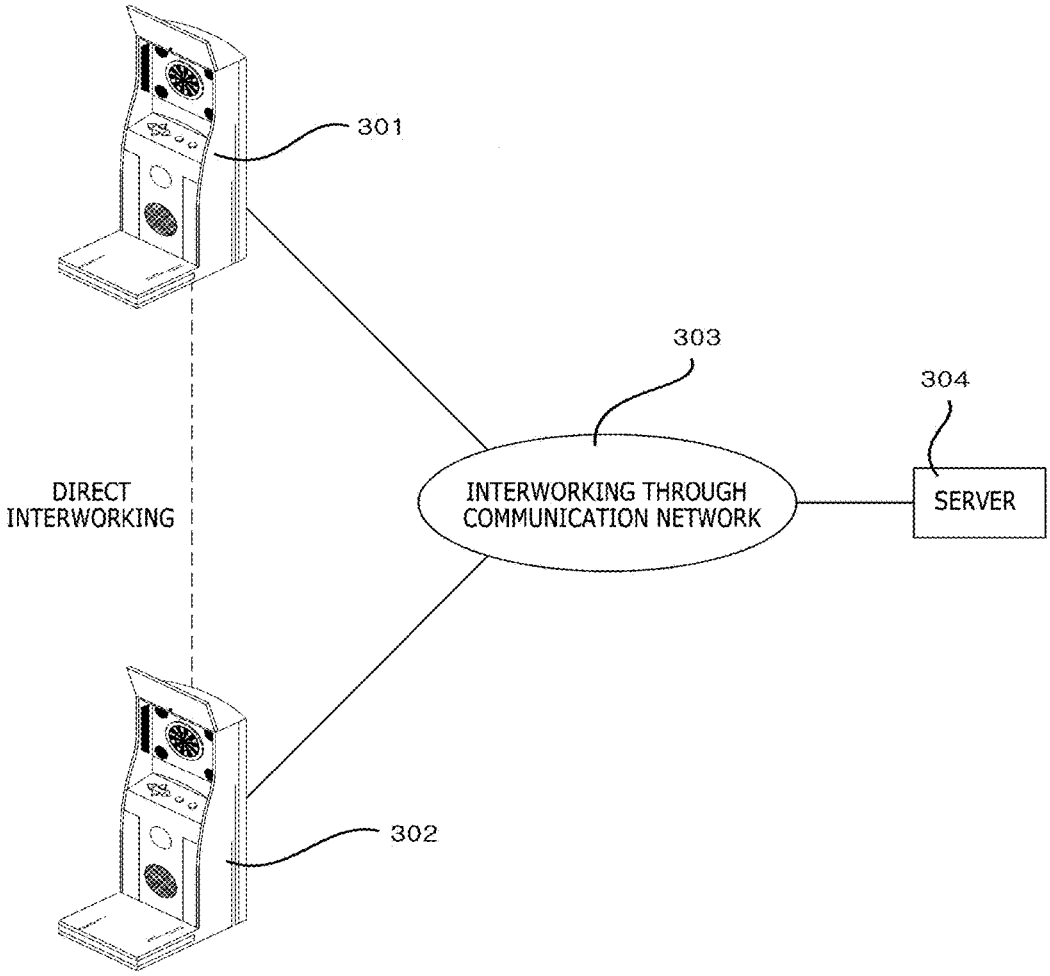
FIG. 3 is a schematic view when two or more dart game devices directly interworking with each other or connected through a communication network, according to some embodiments of the present disclosure.

FIG. 3 is a schematic view when two or more dart game devices interwork with each other or connected through a communication network.

In some embodiments, the dart game device 301 is interworking with the external dart game device 302 according to the present disclosure as described in FIG. 3. In these embodiments, a light source unit of a dart game device 301 and a light source unit of the external dart game device 302 therearound simultaneously flicker or change colors of the light source units, and as a result, players dynamically enjoy a dart game of the dart game devices and further, an interest in the dart game devices.

In detail, when two or more players enjoy the dart game in a match-up mode, in the case where one player succeeds in a predetermined event which is not high in probability, in some embodiments, in the case where a red eye is hit continuously three times, a light source which is very splendid and dazzling in the dart game device of a match-up counterpart is generated or a light source by which the dart target is not well seen is generated, and as a result, an interest in the dart game itself is further incurred.

In these embodiments, when the dart hits a predetermined region of the target, a region of a target, corresponding to the external dart game device 302, is deactivated and further, the light source flickers.

In some embodiments, a server 304 is connected to both of the dart game devie 301 and the external dart game device 302 via a network 303.

Figure 9:
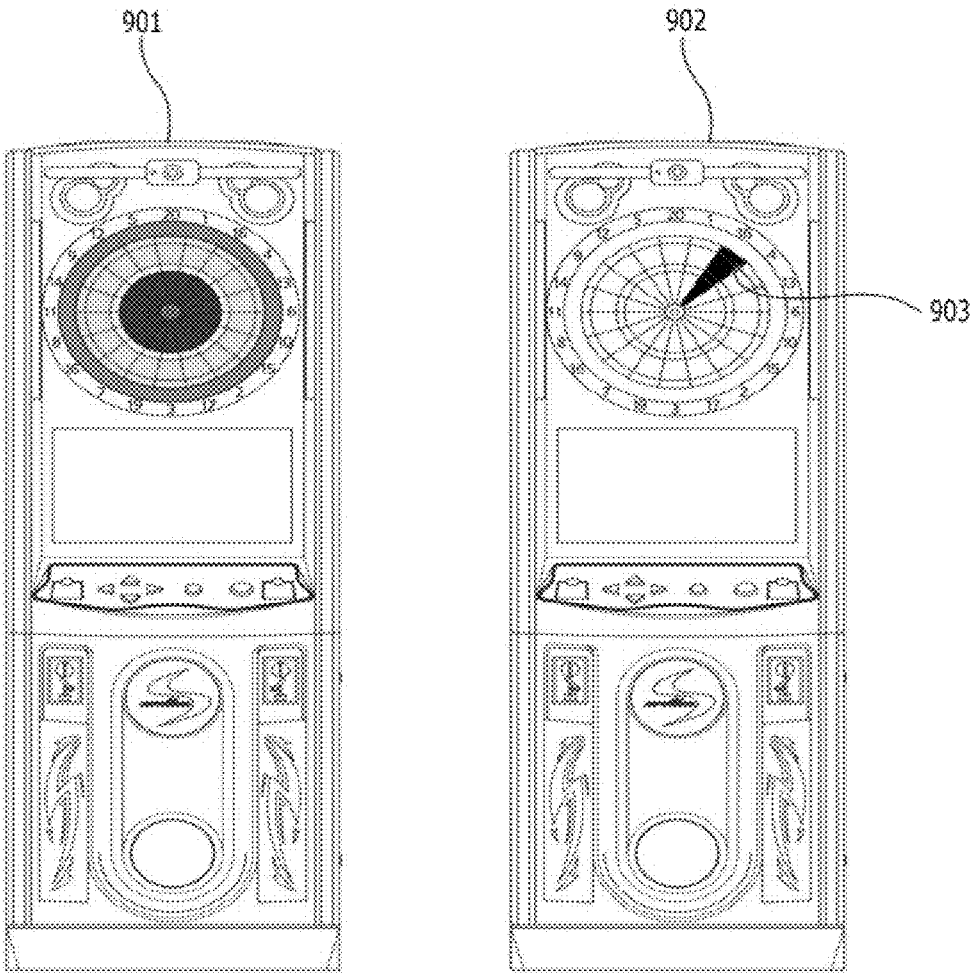
FIG. 9 is a schematic diagram illustrating a shape in which the dart game device interworks with one or more external devices, according to some embodiments of the present disclosure.

In some embodiments, as illustrated in FIG. 9, when a player of a dart game device 901 scores a high point, a predetermined target region 903 of an external dart game device 902 is deactivated and although a player of the external dart game device 902 hits a dart on the predetermined target region 903, the hit by the dart is not recognized as the point.

Figure 10:
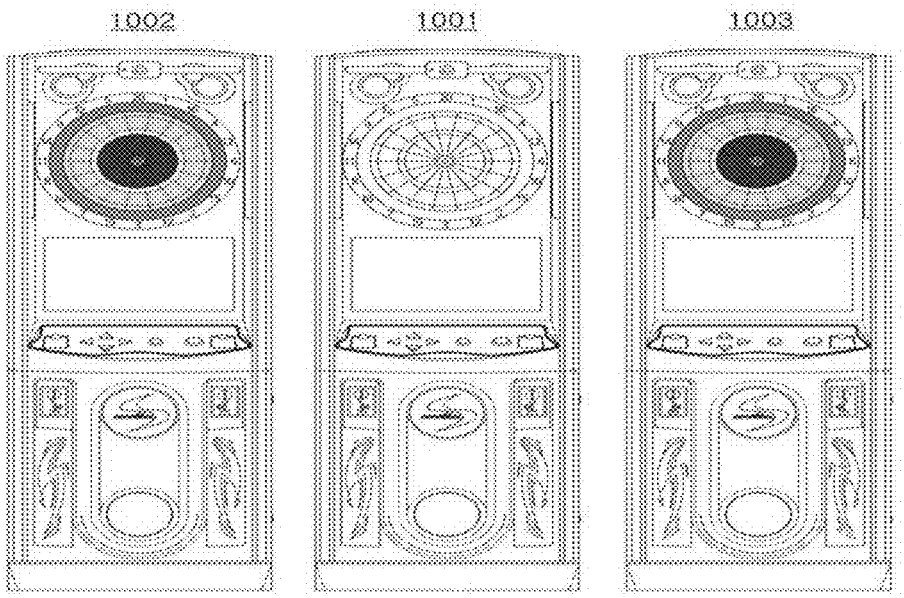
FIG. 10 is a schematic diagram of a dart game device interworking with one or more external devices, according to some other embodiments of the present disclosure.

Further, in some embodiments, as illustrated in FIG. 10, when a player of a dart game device 1001 makes a high point, a plurality of external dart game devices 1002 and 1003 simultaneously flickers or displays a specific animation effect.

In some embodiments, the dart game device 1101 includes a plate structure laid under a player of the dart game device, a behind structure disposed behind a player, a roof structure roofing the player, one or more side structure disposed on one or more side of the player, in addition to a body of the dart game device. Further, each of the plurality of external dart game devices 1102 and 1103, as the dart game device, includes the plate structure laid under a player of the external device, the behind structure disposed behind the player, the roof structure roofing the player, the one or more side structure disposed on the one or more sides of the player, and the like in addition the body of the dart game device, light source units and sound source units installed in the respective structures, which output light or sound in predertermined patterns.

Figure 11:
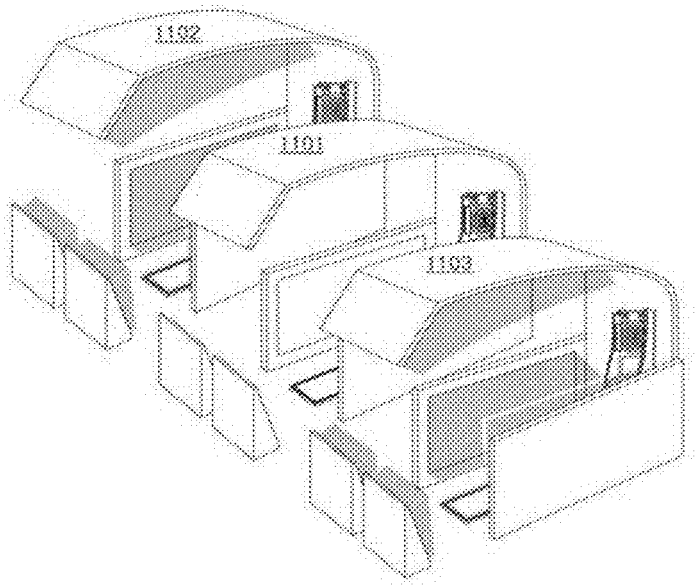
FIG. 11 is a schematic diagram of the dart game device interworking with one or more external devices, according to some other embodiments of the present disclosure.

In some embodiments, as illustrated in FIG. 11, when the player of the dart game device 1101 continuously hits the red eye three times, by a dart, all of the light source units installed in the dart game device 1101 and the light source units installed in the external devices 1102 and 1103 flicker and a predetermined pattern of a sound source effect is executed in all of the sound source units.

The description of the presented embodiments is provided so that one who ordinarily skilled in the art of the present disclosure uses or implements the dart game device of the present disclosure. Tho one who ordinarily skilled in the art would be able to make various modifications of the embodiments, and general principles defined herein is applied to other embodiments without departing from the scope of the present disclosure. Therefore, the present disclosure is not limited to the embodiments presented herein, but should be analyzed within the widest range which is consistent with the principles and new features presented herein.

What is claimed is:

1. A dart game device for interworking with at least one external device, the dart game device comprising:

a dart target having a plurality of point regions;

a sensing unit configured to sense a hit to the dart target by a dart;

a light source unit configured to output light in a light pattern, wherein the light pattern depends on an occurrence of an event;

a sound source unit configured to output sound in a sound pattern, wherein the sound pattern depends on the occurrence of the event; and a communication unit configured to communicate with the external device, and control the external device, in response to the occurrence of the event, to output light in the light pattern, or to output sound in the sound pattern, wherein the dart game device further comprising:

two side walls disposed on and extended along both sides of the dart game device; and at least one additional structure selected from the group consisting of a plate structure laid under a player of the dart game device, a behind structure disposed behind the player, and a roof structure roofing the player, wherein each of two side walls and the at least one additional structure of the dart game device comprises at least one of an additional light source unit and an additional sound source unit, wherein the external device is an external dart game device comprising:

two side walls disposed on and extended along both sides of the external dart game device; and at least one additional structure selected from the group consisting a plate structure laid under an external player of the external dart game device, a behind structure disposed behind the external player, and a roof structure roofing the external player, wherein each of the two side walls and the at least one structure of the external dart game device comprises at least one of an external light source unit and an external sound source unit, and wherein, when the event is the hit to the dart target by the dart, in the case where the dart hits a predetermined region of the dart target of the dart game device, the communication unit is further configured to:

control the external device to output light or sound in a predetermined pattern, and control the additional sound source unit and the external sound source unit to output sound in a predetermined pattern, and control the additional light source unit and the external light source unit to output sound in a predetermined pattern.

2. The dart game device of claim 1, wherein the light source unit is further configured to flicker the light in a first light pattern, and change a color of the light in a second light pattern, whereint the first and second light patterns depend on the occurrence of the event.

3. The dart game device of claim 1, wherein the event includes at least one selected from the group consisting of an identification of a player, the hit to the dart target by the dart, a change of the player, and game ending.

4. The dart game device of claim 1, wherein the communication unit is further configured to download one selected from the group consisting of the light pattern and the sound pattern, from a server which stores the patterns of lighing and sounding.

5. The dart game device of claim 4, wherein at least one of the light pattern and the sound pattern is downloaded from the server via the communication unit, and the other pattern is stored in a memory unit of the dart game device.

6. The dart game device of claim 1, wherein the communication unit is further configured to enable two or more dart game devices, which are separated from each other, to play a dart game together, through the communication unit.

7. The dart game device of claim 1, wherein, when the event is the hit to the dart target by the dart, in the case where the dart hits a predetermined region of the dart target of the dart game device, the communication unit is further configured to control a dart target of the external dart game device to flicker.

8. The dart game device of claim 1, wherein, when the event is the hit to the dart target by the dart, in the case where the dart hits a predetermined region of the dart target of the dart game device, the communication unit is further configured to control a region of a dart target of the external dart game device, which correspondes to the predetermined region of the dart target of the dart game device, to be deactivated.

9. The dart game device of claim 1, wherein, when the event is the hit to the dart target by the dart, in the case where the dart hits a predetermined region of the dart target of the dart game device, the communication unit is configured to control the external device to output light or sound in a predetermined pattern.

10. The dart game device of claim 1, further comprising:

a memory unit configured to store at least one of the light pattern and the sound pattern.

11. The dart game device of claim 1, wherein the additional light source unit is configured to output light in synchronization with the light source, and wherein the additional sound source unit is configured to output sound in synchronization with the sound source unit.

12. The dart game device of claim 1, wherein the light source unit of the dart game device is further configured to flicker the light in a first light pattern, and change a color of the light in a second light pattern, wherein the first and second light patterns depend on the occurrence of the event, and wherein the external light source unit of the external dart game device is further configured to flicker the light of the external light source unit in the first light pattern, and change a color of the light of the external light source unit in the second light pattern.

13. The dart game device of claim 1, wherein the communication unit is configured to control the external device to interwork with the dart game device in real time.

14. The dart game device of claim 1, wherein the at least one additional structure of the dart game device comprises:

a plate structure comprising at least one of an additional light source unit and an additional sound source unit and laid under a player of the dart game device; and one selected from the group consisting of a behind structure comprising at least one of an additional light source unit and an additional sound source unit and disposed behind the player of the dart game device, and a roof structure comprising at least one of an additional light source unit and an additional sound source unit and roofing the player of the dart game device, and wherein the at least one additional structure of the external dart game device comprises:

a plate structure comprising at least one of an external light source unit and an external sound source unit and laid under a player of the external dart game device; and one selected from the group consisting of a behind structure comprising at least one of an external light source unit and an external sound source unit and disposed behind the player of the external dart game, and a roof structure comprising at least one of an external light source unit and an external sound source unit and roofing the player of the external dart game.

15. The dart game device of claim 1, wherein the at least one additional structure of the dart game device comprises:

a plate structure comprising at least one of an additional light source unit and an additional sound source unit and laid under a player of the dart game device;

a behind structure comprising at least one of an additional light source unit and an additional sound source unit and disposed behind the player of the dart game device; and a roof structure comprising at least one of an additional light source unit and an additional sound source unit and roofing the player of the dart game device, and wherein the at least one additional structure of the external dart game device comprises:

a plate structure comprising at least one of an external light source unit and an external sound source unit and laid under a player of the external dart game device;

a behind structure comprising at least one of an external light source unit and an external sound source unit and disposed behind the player of the external dart game device; and a roof structure comprising at least one of an external light source unit and an external sound source unit and roofing the player of the external dart game device.

16. A gaming system, comprising a plurality of dart game devices interworking with each other, each of the dart game devices comprising:

a dart target having a plurality of point regions;

a sensing unit configured to sense a hit to the dart target by a dart;

a light source unit configured to output light in a light pattern, wherein the light pattern depends on an occurrence of an event;

a sound source unit configured to output sound in a sound pattern, wherein the sound pattern depends on the occurrence of the event; and a communication unit configured to communicate with at least one further dart game device among the plurality of dart game devices, and control the at least one further dart game device, in response to the occurrence of the event, to output light in the light pattern, or to output sound in the sound pattern, wherein the dart game device further comprising:

two side walls disposed on and extended along both sides of the dart game device; and at least one additional structure selected from the group consisting of a plate structure laid under a player of the dart game device, a behind structure disposed behind the player, and a roof structure roofing the player, wherein each of the two side walls and the at least one additional structure of the dart game device comprises at least one of an additional light source unit and an additional sound source unit, wherein the external device is an external dart game device comprising:

two side walls disposed on and extended along both sides of the external dart game device; and at least one additional structure selected from the group consisting: a plate structure laid under an external player of the external dart game device, a behind structure disposed behind the external player, and a roof structure roofing the external player, wherein each of the two side walls and the at least one structure of the external dart game device comprises at least one of an external light source unit and an external sound source unit, and wherein, when the event is the hit to the dart target by the dart, in the case where the dart hits a predetermined region of the dart target of the dart game device, the communication unit is further configured to:

control the external device to output light or sound in a predetermined pattern, and control the additional sound source unit and the external sound source unit to output sound in a predetermined pattern, and control the additional light source unit and the external light source unit to output sound in a predetermined pattern.

17. A method of playing a dart game performed by a plurality of dart game devices, the method comprising:

detecting, by one of the plurality of dart game devices, an occurrence of an event;

reading, by the one of the plurality of dart game devices, a light pattern and a sound pattern, which are depend on the occurrence of the event;

outputting, by the one of the plurality of dart game devices, light in a light pattern and sound in a sound pattern;

communicating, by the one of the plurality of dart game devices, with at least one further dart game device among the plurality of dart game devices to output light in the light pattern and to output sound in the sound pattern; and outputting, by the at least one further dart game device among the plurality of dart game devices, light in the light pattern and sound in the sound pattern, wherein the dart game device further comprising:

two side walls disposed on and extended along both sides of the dart game device; and at least one additional structure selected from the group consisting of a plate structure laid under a player of the dart game device, a behind structure disposed behind the player, and a roof structure roofing the player, wherein each of the two side walls and the at least one structure of the dart game device comprises at least one of an additional light source unit and an additional sound source unit, wherein the external device is an external dart game device comprising:

two side walls disposed on and extended along both sides of the external dart game device; and at least one additional structure selected from the group consisting: a plate structure laid under an external player of the external dart game device, a behind structure disposed behind the external player, and a roof structure roofing the external player, wherein each of the two side walls and the at least one structure of the external dart game device comprises at least one of an external light source unit and an external sound source unit, and wherein, when the event is the hit to the dart target by the dart, in the case where the dart hits a predetermined region of the dart target of the dart game device, the communication unit is further configured to:

control the external device to output light or sound in a predetermined pattern, and control the additional sound source unit and the external sound source unit to output sound in a predetermined pattern, and control the additional light source unit and the external light source unit to output sound in a predetermined pattern.

* * * * *